US008090293B2

(12) United States Patent
Arai et al.

(10) Patent No.: US 8,090,293 B2
(45) Date of Patent: Jan. 3, 2012

(54) PROCESS CARTRIDGE AND IMAGE FORMING APPARATUS EMPLOYING SAME

(75) Inventors: Yuji Arai, Kawasaki (JP); Hiroyuki Nagashima, Yokohama (JP); Nobuo Kuwabara, Yokohama (JP); Fumihito Itoh, Kawasaki (JP); Hiroshi Ono, Tokyo (JP); Ken Amemiya, Tokyo (JP); Masahiko Shakuto, Zama (JP); Toshio Koike, Machida (JP); Michiya Okamoto, Zama (JP); Tomokazu Mochizuki, Sagamihara (JP); Masayuki Yamane, Yokohama (JP); Takeshi Uchitani, Yamato (JP); Eisuke Hori, Tokyo (JP); Hideki Kimura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 323 days.

(21) Appl. No.: 12/461,362

(22) Filed: Aug. 10, 2009

(65) Prior Publication Data

US 2010/0034557 A1 Feb. 11, 2010

(30) Foreign Application Priority Data

Aug. 8, 2008 (JP) ..... 2008-205652
Apr. 17, 2009 (JP) ..... 2009-100655

(51) Int. Cl.
*G03G 21/18* (2006.01)

(52) U.S. Cl. ..... 399/113; 399/107; 399/111

(58) Field of Classification Search ..... 399/107, 399/111, 113
See application file for complete search history.

(56) References Cited

U.S. PATENT DOCUMENTS

| | | | | |
|---|---|---|---|---|
| 7,024,133 | B2 | 4/2006 | Nagashima et al. | |
| 7,136,610 | B2 | 11/2006 | Arai et al. | |
| 7,272,342 | B2 | 9/2007 | Nagashima et al. | |
| 7,305,203 | B2 | 12/2007 | Sampe et al. | |
| 7,340,198 | B2 * | 3/2008 | Takigawa | 399/113 |
| 7,389,069 | B2 | 6/2008 | Yoshino et al. | |
| 7,486,916 | B2 | 2/2009 | Tsuda et al. | |
| 7,546,064 | B2 | 6/2009 | Yoshino et al. | |
| 2001/0024581 | A1 * | 9/2001 | Miyabe et al. | 399/113 |
| 2003/0113131 | A1 * | 6/2003 | Watanabe et al. | 399/113 |
| 2004/0170447 | A1 | 9/2004 | Arai et al. | |
| 2004/0170448 | A1 | 9/2004 | Tanaka | |
| 2005/0031374 | A1 | 2/2005 | Nagashima et al. | |
| 2005/0238384 | A1 | 10/2005 | Sampe et al. | |
| 2006/0002736 | A1 * | 1/2006 | Kikuchi et al. | 399/113 |
| 2006/0110184 | A1 | 5/2006 | Yoshino et al. | |

(Continued)

FOREIGN PATENT DOCUMENTS

JP 5-281848 10/1993

(Continued)

*Primary Examiner* — Ryan Walsh
(74) *Attorney, Agent, or Firm* — Harness, Dickey & Pierce, P.L.C.

(57) ABSTRACT

A process cartridge detachably attached to an image forming apparatus includes a first subunit, a second subunit, a first positioning member, and a second positioning member. The first subunit accommodates a photoconductor therein. The second subunit accommodates a developer applicator therein. The photoconductor and the developer applicator are arranged substantially parallel to each other to define a development gap therebetween. The first positioning member is fastened to both the first and second subunits to position ends of the photoconductor and the developer applicator on a first side of the respective subunits. The second positioning member is fastened to only one of the first and second subunits to position ends of the photoconductor and the developer applicator on a second side of the respective subunits opposite to the first side. An image forming apparatus employing such a process cartridge is also disclosed.

13 Claims, 8 Drawing Sheets

U.S. PATENT DOCUMENTS

| | | | |
|---|---|---|---|
| 2006/0275053 | A1 | 12/2006 | Nagashima et al. |
| 2007/0059035 | A1 | 3/2007 | Yoshino et al. |
| 2007/0081835 | A1 | 4/2007 | Tsuda et al. |
| 2008/0226311 | A1 | 9/2008 | Senoh et al. |

FOREIGN PATENT DOCUMENTS

| | | |
|---|---|---|
| JP | 2003-91160 | 3/2003 |
| JP | 2006-058705 | 3/2006 |
| JP | 2006-58705 | 3/2006 |

* cited by examiner

PROCESS CARTRIDGE AND IMAGE FORMING APPARATUS EMPLOYING SAME

CROSS-REFERENCE TO RELATED APPLICATIONS

The present patent application claims priority pursuant to 35 U.S.C. §119 from Japanese Patent Application Nos. 2008-205652 and 2009-100655, filed on Aug. 8, 2008, and Apr. 17, 2009, respectively, which are hereby incorporated by reference herein in their entirety.

BACKGROUND OF THE INVENTION

1. Field of the Invention

The present invention relates to a process cartridge and an image forming apparatus employing the same, and more particularly, to a process cartridge in which various imaging components including a photoconductor and a developer applicator are integrated into a single unit for detachable attachment to an image forming system, and an electrophotographic image forming apparatus, such as a photocopier, printer, facsimile, etc., employing such a process cartridge.

2. Discussion of the Background

Electrophotographic process cartridges are employed in many image forming systems, such as photocopiers, facsimiles, printers, etc., in which various imaging components are assembled into a single replaceable unit detachably attachable to an image forming apparatus. A typical architecture for a process cartridge includes a photoconductor section accommodating a drum-shaped photoconductor and a developer section accommodating developer with a developer applicator. When assembled and installed, the photoconductor and the developer roller define a development gap or zone therebetween, wherein the developer passes from one surface to another to develop an electrostatic latent image on the photoconductor into visible form.

As inconsistencies in the development process greatly affect final print quality of the image forming system, particularly in terms of toner density of printed images, maintaining a consistent gap between surfaces of the photoconductor and the developer applicator is important.

To provide such an efficient process cartridge, one conventional method proposes an architecture in which a photoconductor unit accommodating a photoconductive drum and a development unit accommodating a developer roller are assembled into a single unit with a pair of positioning members. The pair of positioning members, each screwed onto a side wall of the photoconductor unit, hold ends of the photoconductive drum and the developer roller on opposing sides of the process cartridge.

According to this method, the positioning members disposed on the ends of the photoconductive drum and the developer roller can create and maintain a proper development gap without damaging the photoconductive surface, in contrast to a configuration where a spring-loaded spacer is held against the photoconductive surface to provide spacing between the photoconductor and the developer applicator.

One drawback of this method, however, is that the positioning members attached solely to the photoconductor unit do not maintain the developer unit in position, and the development unit is provided with no support that firmly holds it along the length of the process cartridge. When the process cartridge is installed and operated, the unsteady development unit readily wobbles from side to side upon rotation of the developer roller, resulting in degraded development performance and toner leaking out of the wobbling unit to contaminate the interior of the image forming apparatus.

To address this problem, one possible approach is to fasten the positioning members to both the photoconductor unit and the development unit. However, this approach is not successful where the photoconductor and development units have variations in length (e.g., due to manufacturing variations) relative to their specified design lengths. Even if falling within manufacturing tolerances, such dimensional variations result in irregular side walls onto which the positioning members are fastened, causing displacement and deformation of the positioning members from their intended position and shape. Naturally, the positioning members, once displaced and/or deformed, cannot properly position the photoconductor drum and the developer applicator, resulting in an inconsistent development gap and concomitant variations in density of developed toner images.

Thus, what is needed is a stable and efficient architecture for a process cartridge which can hold a photoconductor and a developer applicator in proper operational position without damaging the photoconductive surface and irrespective of dimensional variations in constituent units of the process cartridge.

SUMMARY OF THE INVENTION

Exemplary aspects of the present invention are put forward in view of the above-described circumstances, and provide a novel process cartridge for use in an electrophotographic image forming apparatus.

In one exemplary embodiment, the novel process cartridge detachably attachable to an image forming apparatus includes a first subunit, a second subunit, a first positioning member, and a second positioning member. The first subunit accommodates a photoconductor therein. The second subunit accommodates a developer applicator therein. The photoconductor and the developer applicator are arranged substantially parallel to each other to define a development gap therebetween. The first positioning member is fastened to both the first and second subunits to position ends of the photoconductor and the developer applicator on a first side of the respective subunits. The second positioning member is fastened to only one of the first and second subunits to position ends of the photoconductor and the developer applicator on a second side of the respective subunits opposite to the first side.

Other exemplary aspects of the present invention provide a novel electrophotographic image forming apparatus employing a process cartridge to perform electrophotographic imaging processes.

In one exemplary embodiment, the image forming apparatus includes one or more process cartridges detachably attachable to the image forming apparatus. Each process cartridge includes a first subunit, a second subunit, a first positioning member, and a second positioning member. The first subunit accommodates a photoconductor therein. The second subunit accommodates a developer applicator therein. The photoconductor and the developer applicator are arranged substantially parallel to each other to define a development gap therebetween. The first positioning member is fastened to both the first and second subunits to position ends of the photoconductor and the developer applicator on a first side of the respective subunits. The second positioning member is fastened to only one of the first and second subunits to position ends of the photoconductor and the developer applicator on a second side of the respective subunits opposite to the first side.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
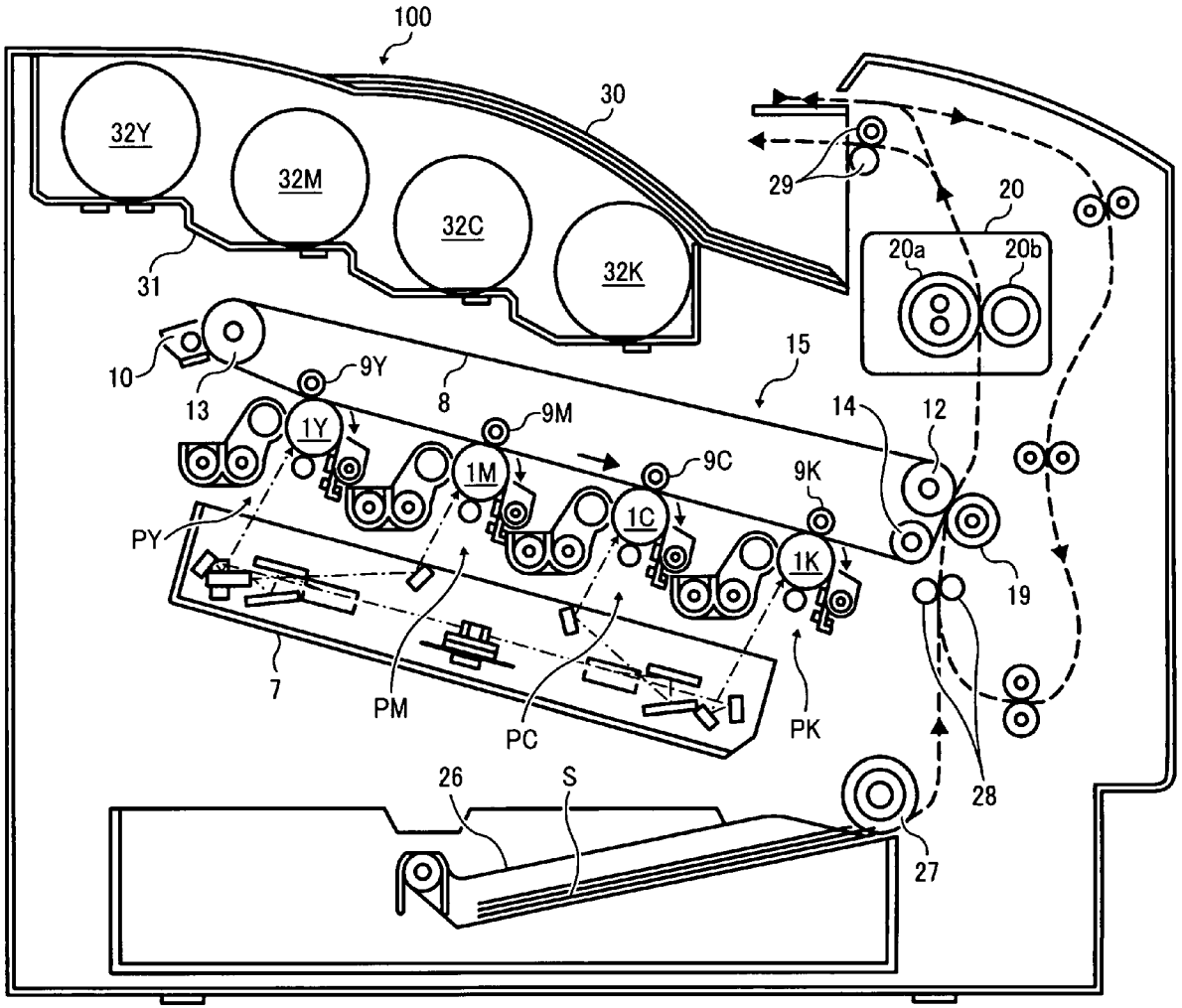
FIG. 1 schematically illustrates an image forming apparatus incorporating a process cartridge according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 incorporating process cartridges according to one embodiment of this patent specification.

As shown in FIG. 1, the image forming apparatus 100 is a tandem color printer including four imaging stations or process cartridges PY, PM, PC, and PK arranged in series along the length of an intermediate transfer unit 15. Also included are a write scanner 7, an image fuser 20, and a toner supply 31, as well as a sheet handling mechanism including a feed roller 27, a pair of registration rollers 28, and a pair of ejection rollers 29 together forming a sheet feed path along which a recording medium such as a sheet of paper S travels from a sheet feed tray 26 upward to an output tray 30.

In the middle of the image forming apparatus 100, each process cartridge, indicated collectively by the reference character P, has a drum-shaped photoconductor 1 to form an electrophotographic image with toner of a particular color, as designated by the suffix letters, "Y" for yellow, "M" for magenta, "C" for cyan, and "K" for black. These process cartridges PY, PM, PC, and PK are supplied with toner from replaceable toner bottles 32Y, 32M, 32C, and 32K accommodated in the toner supply 31 in the upper portion of the apparatus 100.

Immediately above the process cartridges P lies the intermediate transfer unit 15, including an intermediate transfer belt 8, four primary transfer rollers 9Y, 9M, 9C, and 9K, and a belt cleaner 10, as well as a drive roller 12, a cleaning backup roller 13, and a tension roller 14 around which the intermediate transfer belt 8 is entrained. When driven by the roller 12, the intermediate transfer belt 8 travels counterclockwise in the drawing, passing through four primary transfer nips defined between the primary transfer rollers 9 and the corresponding photoconductive drums 1, as well as a secondary transfer nip defined between the roller 12 and a secondary transfer roller 19.

In multicolor image formation, first, the write scanner 7 outputs laser beams L from light sources operating according to image data representing the four primary colors described above. Reflected off facets of a spinning polygon mirror, each laser beam L travels along a specific light path toward the associated process cartridge P.

In each of the process cartridges PY, PM, PC, and PK, the photoconductive drum 1 rotates in a direction indicated by an arrow (clockwise in the drawing) so as to forward an outer photoconductive surface to a series of imaging processes described later with reference to FIG. 2. Each laser beam L entering the process cartridge P exposes the photoconductive surface to generate an electrostatic latent image thereon. The latent image is developed into visible form using toner, and reaches the primary transfer nip between the intermediate transfer belt 8 and the primary transfer roller 9.

At the primary transfer nip, the toner image is transferred from the photoconductive drum 1 to an outer surface of the intermediate transfer belt 8, where the primary transfer roller 9 applies a bias voltage to the opposite (inner) side of the intermediate transfer belt 8. Such transfer process occurs sequentially at the four transfer nips as the intermediate transfer belt 8 travels, so that toner images of different colors are superimposed one atop another to form a multicolor image on the belt surface. After primary transfer, the intermediate transfer belt 8 forwards the multicolor image to the secondary transfer nip between the drive roller 12 and the secondary transfer roller 19.

During such scanning and imaging processes, the feed roller 27 rotates counterclockwise in the drawing to introduce a recording sheet S from the sheet tray 26 toward the pair of registration rollers 28 along the sheet feed path. The registration rollers 9 hold the incoming recording sheet S, and then advance it to the secondary transfer nip in synch with the movement of the intermediate transfer belt 15, so that the multicolor image is transferred from the belt surface onto the recording sheet S.

After passing the secondary transfer nip, the outer surface of the intermediate transfer belt 15 enters the belt cleaner 10, which removes and collects residual toner from the intermediate transfer belt 15 before completion of one belt rotation. At the same time, the recording sheet S bearing the powder toner image thereon is introduced into the image fuser 20. The image fuser 20 fixes the multicolor image into place with heat and pressure at a fixing nip defined between a fixing roller 20*a* and a pressure roller 20*b*.

Thereafter, the recording sheet S is forwarded by the output rollers 29 to the output tray 30 at the top of the apparatus, which completes one operational cycle of the image forming apparatus 100.

In this patent specification, the term "process cartridge" refers to a modular unit in which a photoconductor and at least one of a charging device, a developing device, and a photoconductor cleaner are integrated into a single unit for detachable attachment to an image forming apparatus. In the embodiment described herein, the process cartridges PY, PM, PC, and PK are substantially identical in basic configuration and operation, except for the color of toner used in the development process. Hence, the following describes configuration of the generalized process cartridge P with features common to all the process cartridges PY, PM, PC, and PK employed in the image forming apparatus 100 without specifying the color of toner used therein.

Figure 2:
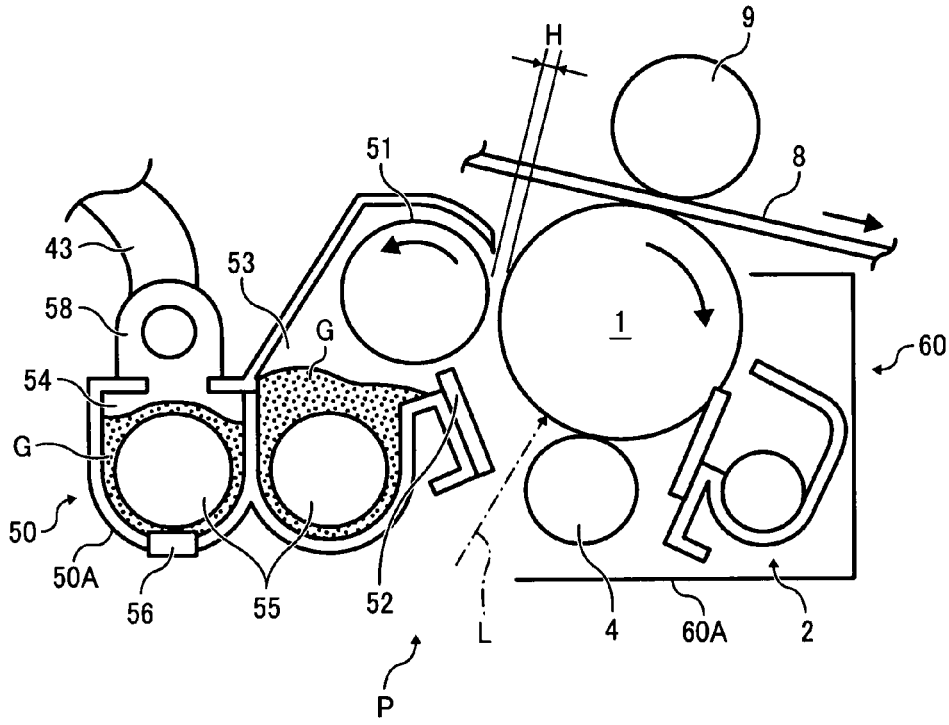
FIG. 2 schematically illustrates an internal configuration of the process cartridge of FIG. 1, in an end-on, axial view thereof.

FIG. 2 schematically illustrates an internal configuration of the process cartridge P employed in the image forming apparatus 100, in an end-on, axial view thereof.

As shown in FIG. 2, the process cartridge P includes a first subunit or photoconductor unit 60 and a second subunit or development unit 50, integrated into a single replaceable unit for detachable attachment to the image forming apparatus 100.

In the process cartridge P, the photoconductor unit 60 includes the photoconductive drum 1 surrounded by various pieces of imaging equipment, such as a drum cleaner 2, a charging device 4, etc., all integrated into a single unit and enclosed in a photoconductor housing 60A. The development unit 50 includes first and second developer chambers 53 and 54 accommodating a two-component developer G formed of toner and carrier particles, a developer applicator or roller 51 containing a stationary magnet with a rotary sleeve rotating therearound, a doctor blade 52 held against the developer roller 51, a pair of screw conveyors 55 one for each developer chamber, a toner concentration sensor 56 disposed in the second chamber 54, and a toner delivery tube 43 connected to the second developer chamber 54 via a toner inlet 58, all integrated into a single unit and enclosed in a developer housing 50A.

While not shown in the FIG. 2, the process cartridge P according to this patent specification incorporates a positioning mechanism with which the photoconductor unit 60 and the development unit 50 are assembled together so as to define a minute development zone or gap H of several hundreds of micrometers between the photoconductive drum 1 and the developer roller 51 as described later in more detail.

As mentioned, the process cartridge P operates as the photoconductive drum 1 rotates clockwise in the drawing to forward its photoconductive surface through a series of imaging processes, including charging, exposure, development, transfer, cleaning, and discharging.

During operation, first, the charging device 4 uniformly charges the photoconductive surface to a given electrostatic potential. Then, the charged photoconductive surface is exposed to the laser beam L emitted from the write scanner 7. The photoconductive surface thus having an electrostatic latent image formed thereon by exposure to the laser beam L is advanced to reach the development unit 50.

In the development unit 50, the first and second screw conveyors 55 rotate to mix and agitate the developer G with new toner supplied from the toner bottle 32 via the delivery tube 43 and the toner inlet 58, the amount of which is adjusted according to the consumption rate in the development process so as to regulate the concentration of toner and keep it within an allowable range as detected by the concentration sensor 56. The rotation of the screw conveyors 55 circulates the mixed material axially within the two chambers in a direction that is perpendicular to the sheet of paper on which the FIG. is drawn to produce triboelectrical charges within the developer G so as to electrostatically attract the toner to the carrier.

Downstream of the mixing process, the developer roller 51 attracts the magnetic carrier carrying the toner with a magnetic field formed around the rotating sleeve. A layer of developer thus formed on the developer roller 51 is trimmed to a desired thickness by the doctor blade 52. The developer layer then meets the electrostatic latent image on the photoconductive drum 1 at the development gap H, wherein the toner is transferred from the surface of the developer roller 51 to the surface of the photoconductive drum 1 by an electric field or potential difference between the electrostatic latent image and the developer roller 51, developing a toner image on the photoconductive surface.

Leaving the development gap H, the developer remaining on the developer roller 51 falls down onto the mixture of developer G inside the first developer chamber 53 for recirculation. On the other hand, the developed toner image is transferred from the photoconductive drum 1 to the intermediate transfer belt 8 at the primary transfer nip, where a certain amount of residual toner particles is left behind on the photoconductive surface while most of the particles move to the belt surface.

Thereafter, the drum cleaner 2 cleans the photoconductive surface of residual toner particles, after which a discharging device, not shown, removes residual charges from the photoconductive surface, thereby preparing the photoconductive drum 1 for a subsequent imaging cycle.

Figure 3:
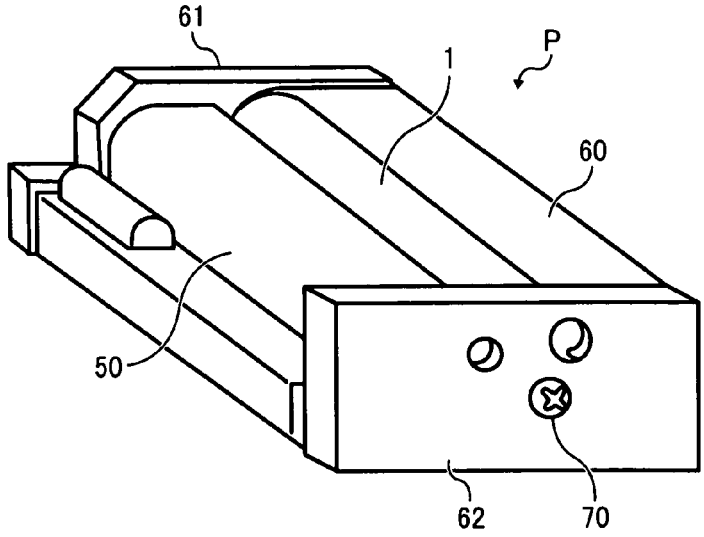
FIG. 3 is a perspective view schematically illustrating the process cartridge with a positioning mechanism according to one embodiment of this patent specification.
Figure 4:
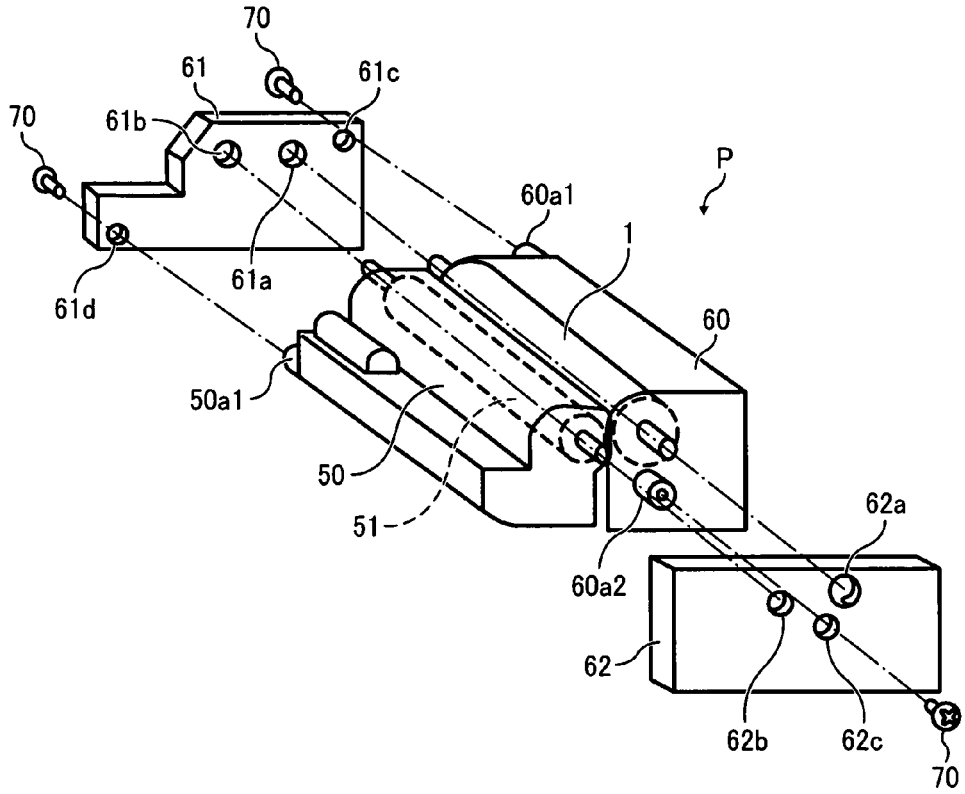
FIG. 4 is an exploded perspective view schematically illustrating the process cartridge of FIG. 3.
Figure 5:
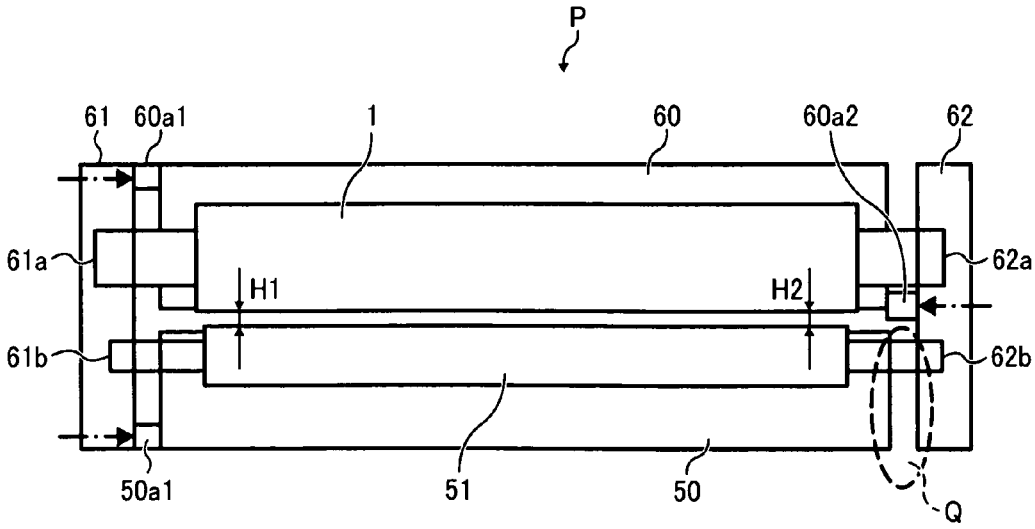
FIG. 5 is a plan view schematically illustrating the process cartridge of FIG. 3.

FIGS. 3 through 5 are perspective, exploded perspective, and plan views, respectively, schematically illustrating the process cartridge P with the positioning mechanism according to one embodiment of this patent specification.

As shown in FIGS. 3 through 5, the process cartridge P includes a first positioning plate 61 and a second positioning plate 62, the former located on a first side of the photoconductor and developer housings, and the latter located on a second side opposite to the first side of the photoconductor and developer housings.

In the photoconductor unit 60, the photoconductive drum 1 is rotatably supported on the photoconductor housing by a pair of bearings, not shown, on a drum shaft extending along the length of the housing and protruding outward from two side walls of the housing.

Similarly, in the development unit 50, the developer roller 51 is rotatably supported on the developer housing by a pair of bearings, not shown, on a roller shaft extending along the length of the housing and protruding outward from two side walls of the housing.

On the first side of the process cartridge P, the first positioning plate 61 has a pair of precisely spaced positioning holes 61*a* and 61*b*, one for positioning the photoconductive drum 1 and the other for positioning the developer roller 51, as well as a pair of screw holes 61*c* and 61*d*, one for fastening to the photoconductor unit 60 and the other for fastening to the development unit 50.

On the second side of the process cartridge P, the second positioning plate 62 has a pair of precisely spaced positioning holes 62*a* and 62*b*, one for positioning the photoconductive drum 1 and the other for positioning the developer roller 51, as well as a screw hole 62*c* for fastening to the photoconductor unit 60. There is no screw hole for fastening the development unit 50 in the second positioning plate 62.

The first positioning plate 61 positions the photoconductive drum 1 by holding the end of the drum shaft in the positioning hole 61*a* and the developer roller 51 by holding the end of the roller shaft in the positioning hole 61*b*, so as to define a first gap H1 between surfaces of the photoconductive drum 1 and the developer roller 51 on the first side of the development zone H.

Similarly, the second positioning plate 62 positions the photoconductive drum 1 by holding the end of the drum shaft in the positioning hole 62*a*, and the developer roller 51 by holding the end of the roller shaft in the positioning hole 62*b*, so as to define a second gap H2 between surfaces of the photoconductive drum 1 and the developer roller 51 on the second side of the development zone H.

When properly positioned with the precision positioning holes, the photoconductive drum 1 and the developer roller 51 are substantially parallel to each other, with the gaps H1 and H2 on the first and second sides being equal to each other to define a consistent, regular, evenly spaced development gap H.

With the photoconductive drum 1 and the developer roller 51 thus in proper operational position, the first positioning plate 61 is fastened to both the photoconductor unit 60 and the development unit 50 with a screw 70 inserted into the screw hole 61*c* to mate with a female-threaded boss 60*a*1 on the first side wall of the photoconductor housing, and another screw 70 inserted into the screw hole 61*d* to mate with a female-threaded boss 50*a*1 on the first side wall of the developer housing. In contrast to the first positioning plate 61, the second positioning plate 62 is fastened solely to the photoconductor unit 60 with a screw 70 inserted into the screw hole 62*c* to mate with a female-threaded boss 60*a*2 on the second side wall of the photoconductor housing.

Consequently, with particular reference to FIG. 5, the first positioning plate 61 has two fastening points at which it is fastened to the process cartridge P, one located on the photoconductor unit 60 and the other on the development unit 50, as indicated by dotted arrows in the drawing. On the other hand, the second positioning plate 62 has a single fastening point located solely on the photoconductor unit 60, as indicated by a dotted arrow in the drawing.

Using the dual-plate positioning mechanism described above, the process cartridge P according to this patent specification can properly position the photoconductive drum 1 and the developer roller 51 to form an adequate development gap without the risk of damaging the photoconductive surface, in contrast to a configuration in which a spring-loaded spacer directly contacts the surfaces of photoconductor and developer applicator to provide a spacing therebetween.

Moreover, the positioning mechanism according to this patent specification can stably hold the photoconductor unit 60 and the development unit 50 between the first and second sides of the process cartridge P, with the former having both sides secured to the positioning plates 61 and 62, and the latter having one side secured to the first positioning plate 61.

Although the development unit 50 is not secured to the second positioning plate 62, the screw fastening provided on the first side is sufficient to prevent the developer housing from wobbling or moving from side to side upon rotation of the developer roller 51. Such stability of the photoconductor unit 60 and the development unit 50 prevents image defects due to displacement or wobbling of the subunits during development processes, as well as contamination of the interior of the image forming apparatus caused by toner leaking out of a destabilized developer housing.

Further, having one positioning plate 62 attached solely to the photoconductor unit 60 and not to the development unit 50 prevents deformation and displacement of both positioning plates screwed onto the side wall(s) of the process cartridge P, where the developer housing and/or the photoconductor housing have variations in length, for example, due to manufacturing variations. Maintaining the proper shape and position of the positioning plates in turn maintains the photoconductive drum 1 and the developer roller 51 in their proper operational position (i.e., with the gaps H1 and H2 equal to each other), thereby preventing image defects caused by an inconsistent development gap, such as uneven image density of developed toner images.

To ensure the positioning mechanism properly operates, it is desirable to provide the second positioning plate 62 out of contact with the development unit 50 with a space Q left between the adjacent surfaces of the positioning plate 62 and the developer housing as shown in FIG. 5. This prevents the development unit 50 from interfering with the second positioning plate 62, thereby securely preventing the second positioning plate 62 from deformation and displacement in the presence of dimensional variations of the process cartridge P.

It is also desirable that the fastening point between the second positioning plate 62 and the photoconductor unit 60 be proximal rather than distal of the development unit 50 as particularly shown in the perspective view of FIG. 4. That is, the screw hole 62*c* of the second positioning plate 62 is located adjacent to the positioning holes 62*a* and 62*b* retaining the photoconductive drum 1 and the developer roller 51 close to each other. Such an arrangement contributes to maintaining a uniform development gap between the developer roller 51 and the photoconductive drum 1 even when the positioning plate 62 deforms after installation distal of the fastening point.

Although the embodiment above describes the process cartridge P with the first positioning plate 61 screwed onto the development and photoconductor units 50 and 60 and the second positioning plate 62 screwed onto the photoconductor unit 60, alternatively, it is also possible to attach the second positioning plate 62 solely to the development unit 50 instead of the photoconductor unit 60. Also possible is that the second positioning plate 62 be attached to both the development and photoconductor units 50 and 60, and the first positioning plate 61 attached solely to one of the development and photoconductor units 50 and 60.

Figure 6:
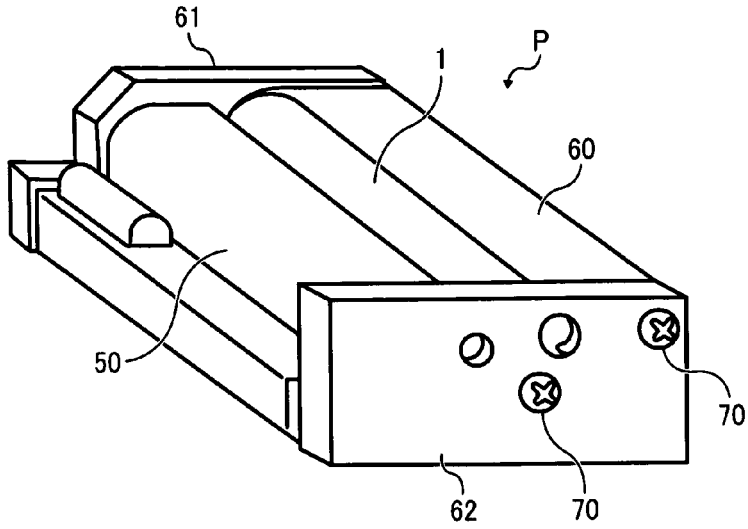
FIG. 6 is a perspective view schematically illustrating the process cartridge with the positioning mechanism according to another embodiment of this patent specification.
Figure 7:
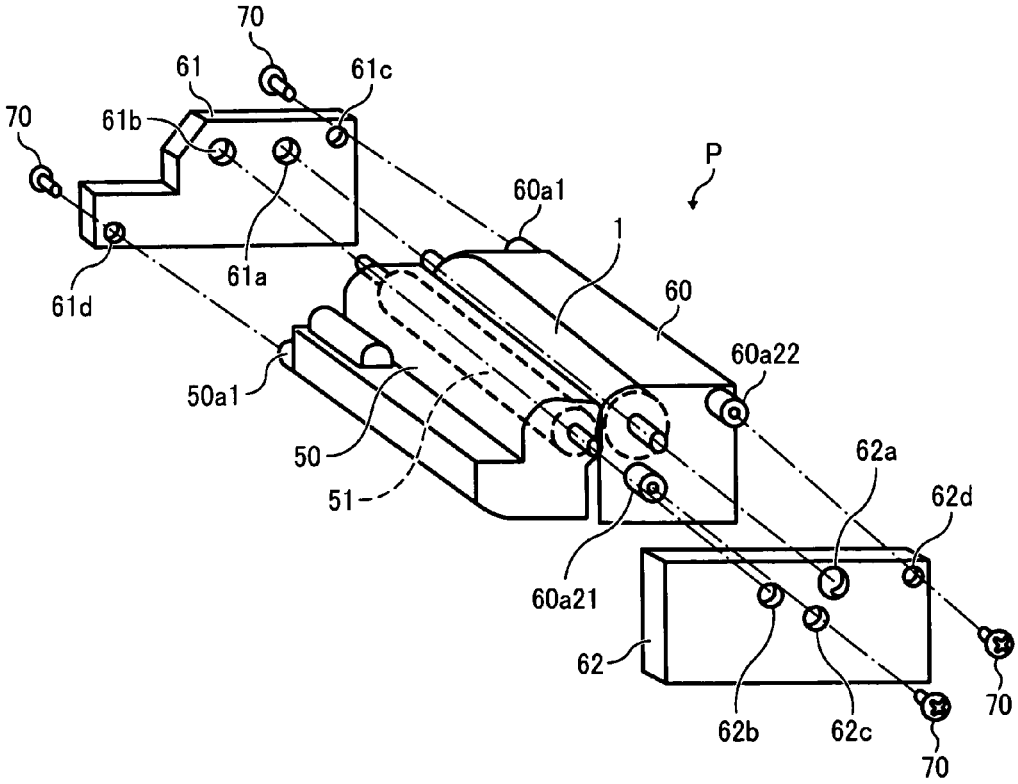
FIG. 7 is an exploded perspective view schematically illustrating the process cartridge of FIG. 6.

Further, instead of attaching the second positioning plate 62 to the photoconductor unit 60 at the single fastening point defined by the screw hole 62*c* and the screw boss 60*a*2, it is also possible to fasten the positioning plate 62 to the photoconductor unit 60 at multiple fastening points. For example, the second positioning plate 62 may have a pair of screw holes 62*c* and 62*d* both for fastening to the photoconductor unit 60 as shown in FIGS. 6 and 7.

In such cases, the second positioning plate 62 is fastened to the photoconductor unit 60 (and not to the development unit 50) by inserting a pair of screws 70 into the screw holes 62*c* and 62*d* to mate with a pair of female-threaded bosses 60*a*21 and 60*a*22 provided on the second side wall of the photoconductor unit 60.

In addition to the effects obtained by fastening the second positioning plate 62 solely to the one subunit 60 of the process cartridge P, the configuration with multiple fastening points can hold the second positioning plate 62 relative to the side walls of the subunits more stably than that possible with a single fastening point.

Preferably, the multiple screw holes 62*c* and 62*d* for fastening to the single subunit 60 are defined in an even, flat portion of the positioning plate 62, so that the multiple fastening points between the second positioning plate 2 and the photoconductor unit 60 are in a single imaginary plane parallel to the side wall of the photoconductor housing. This contributes to holding the positioning plate 62 stable relative to the side walls of the subunits.

Although the second positioning plate 62 is described as a flat plane in FIGS. 6 and 7, the shape of the positioning plate may be other than that depicted in the drawings, such as one with some projections or recesses, as long as it contains a planar portion to bore the screw holes 62*c* and 62*b* to obtain the coplanar fastening points.

Additionally, the screw hole 62*c* of the second positioning plate 62 is adjacent to the positioning holes 62*a* and 62*b* retaining the photoconductive drum 1 and the developer roller 51, so that at least-one of the multiple fastening points between the second positioning plate 62 and the photoconductor unit 60 is proximal of the development unit 50. As in the case of fastening with a single fastening point, such an arrangement contributes to maintaining a uniform development gap between the developer roller 51 and the photoconductive drum 1 even when the positioning plate 62 develops deformation distal of the fastening points.

Figure 8:
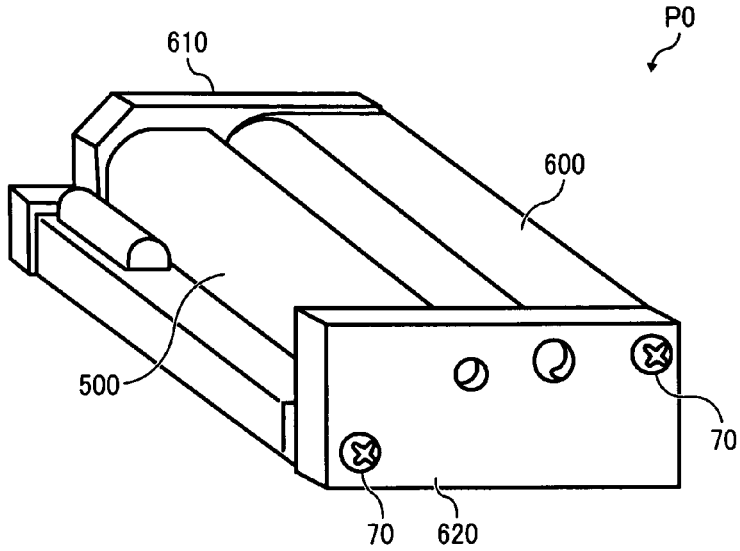
FIG. 8 is a perspective view schematically illustrating a process cartridge with a dual-plate positioning mechanism.
Figure 9:
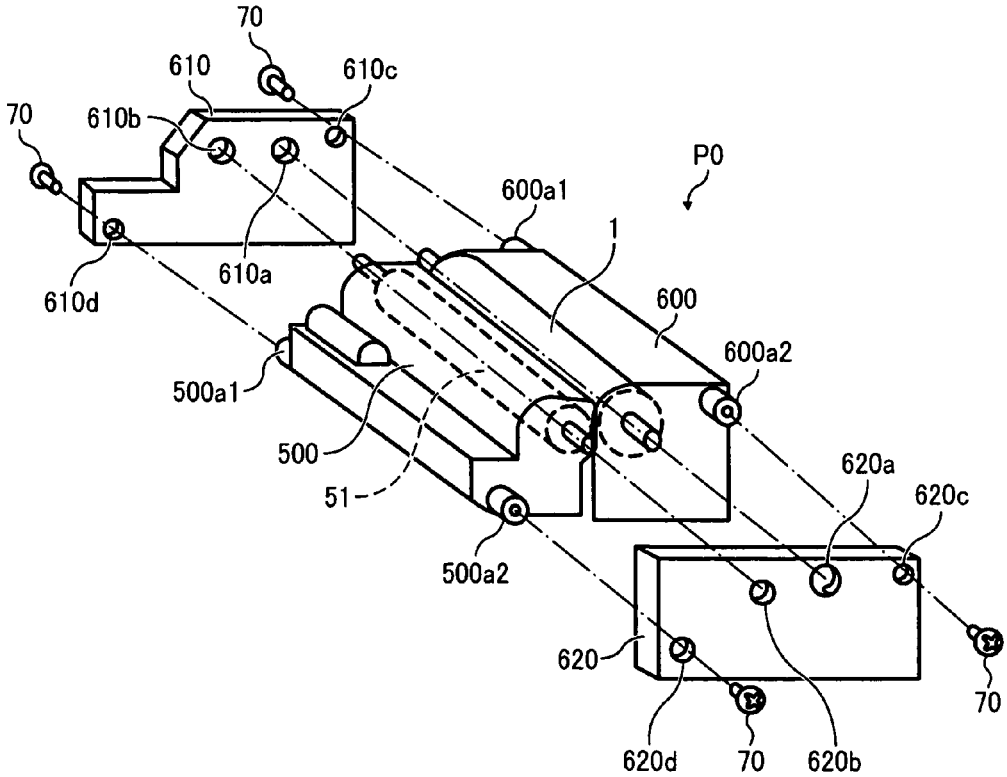
FIG. 9 is an exploded perspective view schematically illustrating the process cartridge of FIG. 8.
Figure 10:
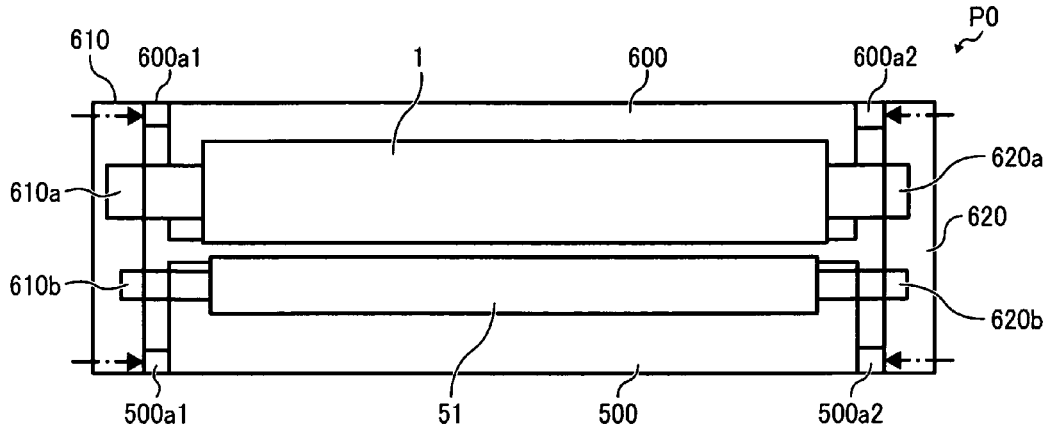
FIG. 10 is a plan view schematically illustrating the process cartridge of FIG. 8.

To facilitate an understanding of the advantages of the process cartridge P according to this patent specification, reference is made to FIGS. 8 through 10, which are perspective, exploded perspective, and plan views, respectively, schematically illustrating a process cartridge P0 employing a dual-plate positioning mechanism that is similar to but nonetheless different from that depicted in FIGS. 3 through 5 for comparison purposes.

As shown in FIGS. 8 through 10, the process cartridge P0 includes a photoconductor unit 600 accommodating a photoconductive drum 1 and a development unit 500 accommodating a developer roller 51, as well as a first positioning plate 610 and a second positioning plate 620, the former located on a first side of the photoconductor and developer housings and the latter located on a second side opposite to the first side the photoconductor and developer housings.

On the first side of the process cartridge P0, the first positioning plate 610 has a pair of positioning holes 610*a* and 610*b*, one for positioning the photoconductive drum 1 and the other for positioning the developer roller 51, as well as a pair of screw holes 610*c* and 610*d*, one for fastening to the photoconductive drum 1 and the other for fastening to the developer roller 51.

On the second side of the process cartridge P0, the second positioning plate 620 has a pair of positioning holes 620*a* and 620*b*, one for positioning the photoconductive drum 1 and the other for positioning the developer roller 51, as well as a pair of screw holes 620*c* and 620*d*, one for fastening to the photoconductive drum 1 and the other for fastening to the developer roller 51.

The first positioning plate 610 positions the photoconductive drum 1 by holding the end of the drum shaft in the positioning hole 610*a* and the developer roller 51 by holding the end of the roller shaft in the positioning hole 610*b*, so as to define a first gap H10 between surfaces of the photoconductive drum 1 and the developer roller 51 on the first side of the development zone H.

Similarly, the second positioning plate 620 positions the photoconductive drum 1 by holding the end of the drum shaft in the positioning hole 620*a* and the developer roller 51 by holding the end of the roller shaft in the positioning hole 620*b*, so as to define a second gap H20 between surfaces of the photoconductive drum 1 and the developer roller 51 on the second side of the development zone H.

The first positioning plate 610 is fastened to both the photoconductor unit 600 and the development unit 500 with one screw 70 inserted into the screw hole 610*c* to mate with a female-threaded boss 600*a*1 on the first side wall of the photoconductor housing, and another screw 70 inserted into the screw hole 610*d* to mate with a female-threaded boss 500*a*1 on the first side wall of the developer housing, as indicated by dotted arrows in FIG. 9.

Similar to the first positioning plate 610, the second positioning plate 620 is fastened to both the photoconductor unit 600 and the development unit 500 with a screw 70 inserted into the screw hole 620*c* to mate with a female-threaded boss 600*a*2 on the second side wall of the photoconductor housing, and another screw 70 inserted into the screw hole 620*d* to mate with a female-threaded boss 500*a*2 on the second side wall of the developer housing, as indicated by dotted arrows in FIG. 9.

In such a configuration, the process cartridge P0 fails to properly position the photoconductive drum 1 and the developer roller 51 when the first and/or second subunits have variations in their length. To illustrate such defects, consider cases in which the subunits 500 and 600 of the process cartridge P0 are undersized or oversized relative to each other in terms of the length between the tips of the two side screw bosses, or where either of the subunits 500 and 600 is sized longer or shorter than a specified design length for the process cartridge with reference to FIGS. 11A and 11B.

Figure 11A:
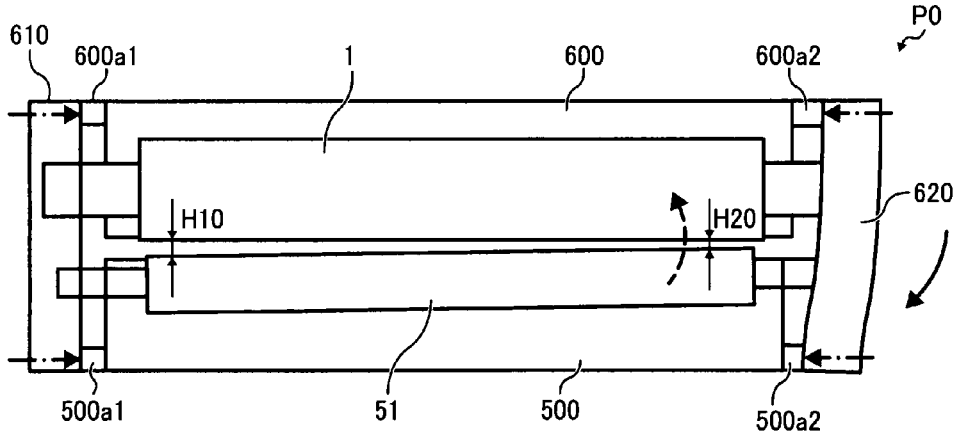
FIGS. 11 and 11B illustrate defects of the positioning mechanism arising from dimensional variations in the process cartridge of FIG. 8.

For example, when the development unit 500 is shorter than the photoconductor unit 600, screwing the second positioning plate 620 on both subunits 500 and 600 can deform the plate 620 inwardly as indicated by a solid arrow in FIG. 11A. Such a deformation changes the relative position between the positioning holes 620*a* and 620*b* on the second positioning plate 620, which displaces the developer roller 51 toward the photoconductive drum 1 on the second side.

Figure 11B:
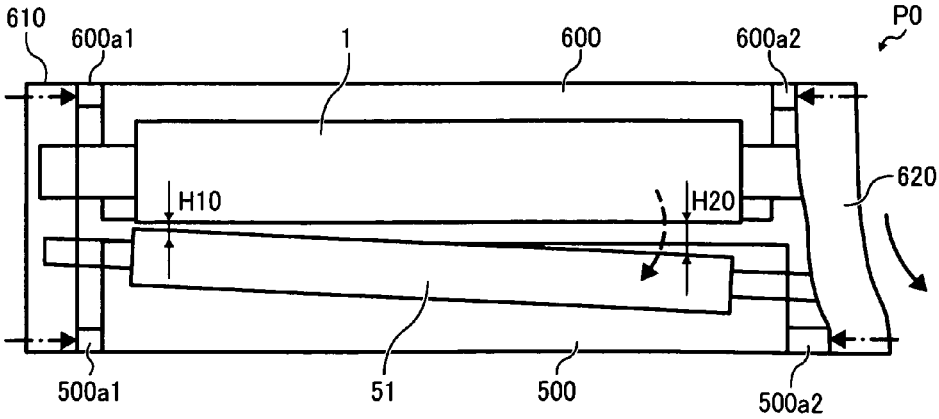

Moreover, when the development unit 500 is longer than the photoconductor unit 600, screwing the second positioning plate 620 on both subunits 500 and 600 can deform the plate 620 outwardly as indicated by a solid arrow in FIG. 11B. Such a deformation changes the relative position between the positioning holes 620*a* and 620*b* on the second positioning plate 620, which displaces the developer roller 51 away from the photoconductive drum 1 on the second side.

In either case, the result is the gap H2 on the second side becoming narrower or wider than the gap H1 on the first side, which means a failure to provide a consistent development gap between the photoconductive drum 1 and the developer roller 51, resulting in variations in density of developed toner images.

By contrast, the process cartridge P according to this patent specification can stably maintain a consistent, regular, evenly spaced development gap between the photoconductive drum 1 and the developer roller 51 irrespective of variations in the length of the first and/or second subunits 50 and 60, in which attaching the second positioning plate 62 to only one of the subunits 50 and 60 prevents it from deformation and displacement.

Figure 12:
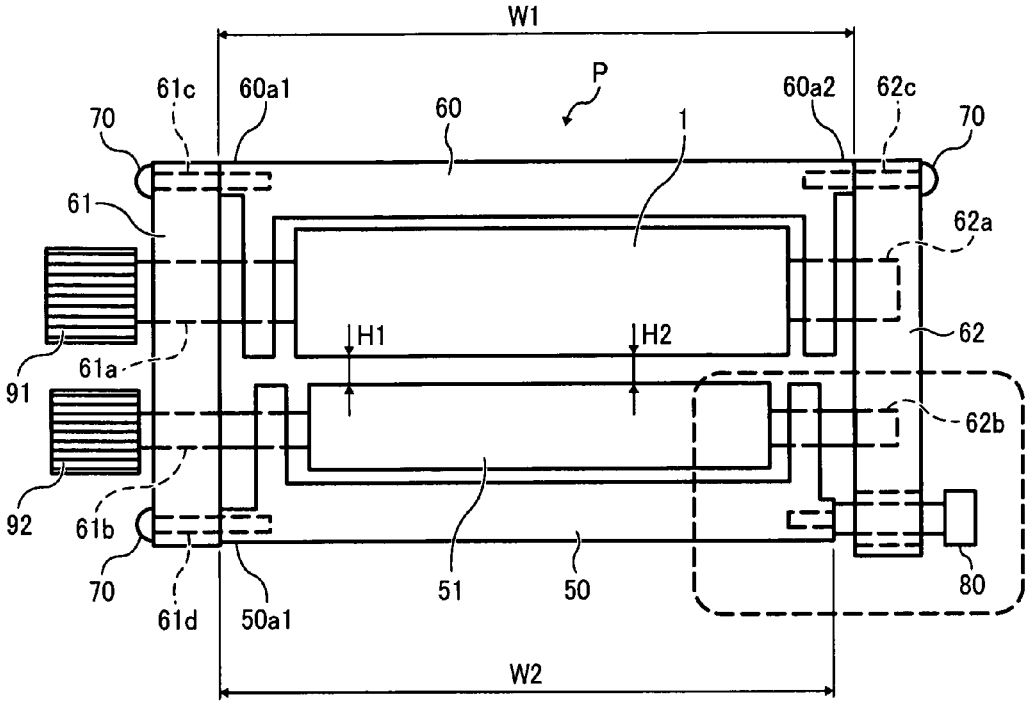
FIG. 12 is a plan view schematically illustrating the process cartridge with the positioning mechanism according to a further embodiment of this patent specification.
Figure 13:
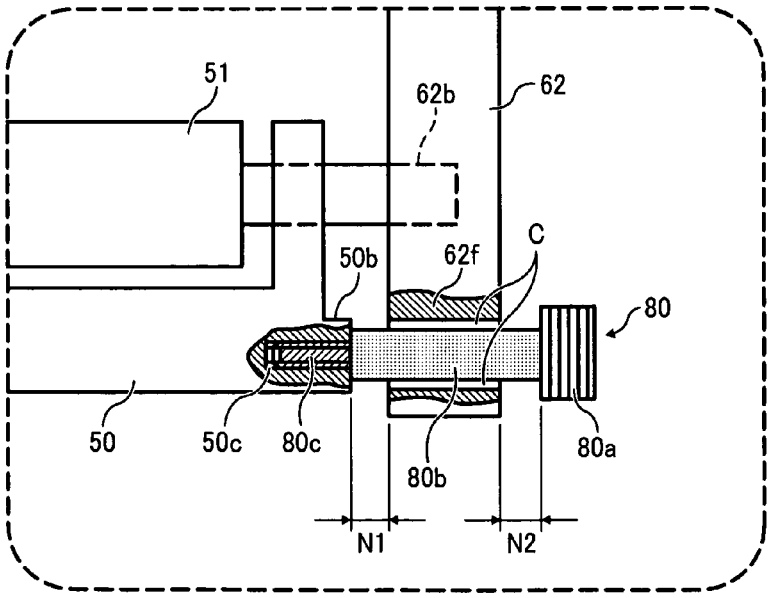
FIG. 13 is an enlarged sectional view illustrating in detail a portion shown as a broken-line rectangle in FIG. 12.

FIG. 12 is a plan view schematically illustrating the process cartridge P according to a further embodiment of this patent specification, and FIG. 13 is an enlarged sectional view illustrating in detail a portion indicated by a broken-line rectangle in FIG. 12.

As shown in FIGS. 12 and 13, the overall configuration of the photoconductor unit 60, the development unit 50, the first positioning plate 61, and the second positioning plate 62 is similar to that depicted in FIGS. 3 through 5, except that the second positioning plate 62 has a through-hole 62*f* to accommodate a motion limiter or shoulder screw 80 engaged with an additional female-threaded boss 50*b* on the second side wall of the development unit 50.

Specifically, the first positioning plate 61 positions the photoconductive drum 1 by holding the end of the drum shaft in the positioning hole 61*a*, and the developer roller 51 by holding the end of the roller shaft in the positioning hole 61*b*, so as to define a first gap H1 between surfaces of the photoconductive drum 1 and the developer roller 51 on the first side of the development zone H.

The first positioning plate 61 is fastened to both the photoconductor unit 60 and the development unit 50 with a screw 70 inserted into the screw hole 61*c* to mate with a female-threaded boss 60*a*1 on the first side wall of the photoconductor housing, and another screw 70 inserted into the screw hole 61*d* to mate with a female-threaded boss 50*a*1 on the first side wall of the developer housing.

The second positioning plate 62 positions the photoconductive drum 1 by holding the end of the drum shaft in the positioning hole 62*a*, and the developer roller 51 by holding the end of the roller shaft in the positioning hole 62*b*, so as to define a second gap H2 between surfaces of the photoconductive drum 1 and the developer roller 51 on the second side of the development zone H.

In contrast to the first positioning plate 61, the second positioning plate 62 is fastened solely to the photoconductor unit 60 with a screw 70 inserted into the screw hole 62*c* to mate with the female-threaded boss 60*a*2 on the second side wall of the photoconductor housing.

With particular reference to FIG. 13, the shoulder screw 80 has a head 80*a*, a shoulder 80*b*, and a male-threaded end 80*c*. The shoulder screw 80 penetrates through the through-hole 62*f* of the second positioning plate 62 with the head end 80*a* projecting from the outer surface of the plate 62 and the threaded end 80*c* mating with a female thread 50*c* cut in the additional boss 50*b* of the development unit 50.

The through-hole 62*f* of the second positioning plate 62 has a diameter smaller than that of the screw head 80*a* but sufficiently greater than that of the screw shoulder 80*b* that the shoulder screw 80 rests in the through-hole 62*f* without contacting the surface of the positioning plate 62 and leaving a clearance C around the screw shoulder 80*b* inside the through-hole 62*f*. The shoulder 80*b* of the screw 80 extends outward from both inner and outer sides of the second positioning plate 62, so as to define adequate gaps N1 and N2 between the threaded boss 50*b* and one end of the through-hole 62*f*, and between the screw head 80*a* and another end of the through-hole 62*f*, respectively.

In such a configuration, the shoulder screw 80, disposed normally out of contact with the second positioning plate 62, serves to restrict displacement and deformation of the second positioning plate 62 to within allowable limits after installation of the process cartridge P. That is, when the second positioning plate 62 moves or bends due to a non-insubstantial external force acting thereupon, or due to loosening of the screw 70 fastening the plate 62 to the photoconductor unit 60, the shoulder screw 80 interferes with the adjacent surface of the through-hole 62*f* to limit excessive motion of the positioning plate 62.

Although the embodiment above describes the motion limiter 80 as a shoulder screw inserted into the through-hole 62*f* of the positioning plate 62, alternatively, it is possible to use other mechanisms to prevent displacement and deformation of the positioning plate 62, such as a stud projecting from the additional boss 50*b* to penetrate through the through-hole 62*f*.

In the embodiment described in FIGS. 12 and 13, the second positioning plate 62 remains out of contact with the development unit 50 and the shoulder screw 80 projecting from the development unit 50. The components of the process cartridge P, including the subunits 50 and 60, the positioning plates, and the shoulder screw 80, are properly dimensioned with respect to each other so that the absence of direct contact between the second positioning plate 62 and the neighboring structure is ensured even when one of the subunits 50 and 60 has a span or length W between two extremities at its maximum allowable limit, and the other has a span or length W between two extremities at its minimum allowable limit.

For example, the process cartridge P may have the photoconductor unit 60 with a nominal length W1 of 300 mm and a specified manufacturing tolerance of ±0.2 mm, and the development unit 50 with a nominal length W2 of 299.6 mm and a specified manufacturing tolerance of ±0.2 mm.

In this case, assembling the process cartridge P with the photoconductor unit 60 having a minimum allowable length W1 of 299.8 mm and the development unit 50 having a maximum allowable length W2 of 299.8 mm results in a minimum possible gap N1 of 0 mm between the second positioning plate 62 and the development unit 50. The resulting gap N1 of 0 mm indicates that no, or at most limited, pressure contact exists between the second positioning plate 62 and the development unit 50, so that no excessive force is applied from the development unit 50 to deform the second positioning plate 62 outward.

Likewise, even when the process cartridge P is assembled with the photoconductor unit 60 of a maximum allowable length and the development unit 50 of a minimum allowable length, the dimensions are properly designed so that the resulting minimum possible gap N2 between the second positioning plate 62 and the screw head 80 does not fall below 0 mm, thereby preventing the second positioning plate 62 from deforming inward.

Alternatively, it is also possible to dimension the components of the process cartridge P with respect to each other so that the second positioning plate 62 remains out of contact with the shoulder screw 80 and the development unit 50 only when each subunit has a variation in length W not exceeding 70% of a specified manufacturing tolerance. Limiting the expected size range for the constituent subunits is reasonable since it increases flexibility in the design of the process cartridge P.

For example, the process cartridge P may have the photoconductor unit 60 with a nominal length W1 of 300 mm and a specified manufacturing tolerance of ±0.2 mm, and the development unit 50 with a nominal length W2 of 299.8 mm and a specified manufacturing tolerance of ±0.2 mm.

In this case, assembling the process cartridge P with the photoconductor unit 60 having a minimum allowable length W1 of 299.8 mm and the development unit 50 having a maximum allowable length W2 of 300.0 mm results in a minimum possible gap N1 of −0.2 mm between the second positioning plate 62 and the development unit 50.

Although the resulting gap N1 falling below 0 mm indicates that the second positioning plate 62 directly contacts the development unit 50, such interference between the second positioning plate 62 and the development unit 50 is not so significant, and does not greatly affect the relative position between the photoconductor drum 1 and the developer roller 51 defining the development gap. Moreover, a failure to meet the requirement of within 70% of the allowable limit is very rare considering that those components are manufactured using high-precision techniques, such as injection molding, and that the probability of obtaining a mass-produced product with its subunits having minimum and maximum allowable sizes is extremely remote and negligible.

In the embodiments described above, preferably, the process cartridge P according to this patent specification has a drive mechanism to impart driving forces to the photoconductive drum 1 and the developer roller 51 mounted on the first side of the respective subunits 60 and 50.

Specifically, with further reference to FIG. 12, the process cartridge P has a drum drive gear 91 on the shaft of the photoconductive drum 1, and a roller drive gear 92 on the shaft of the developer roller 51. When installed, these gears 91 and 92 are engaged with a motor gear provided on the image forming apparatus 100, and serve to transfer driving forces from the motor to rotate the photoconductor drum 1 and the developer roller 51 in opposite directions.

Since the first positioning plate 61 fastened to both the photoconductor unit 60 and the development unit 50 is less susceptible to deformation than the second positioning plate 62, positioning of the drum and roller shafts is more stable on the first side than on the second side. Thus, providing the drive mechanism on the first side rather than on the second side prevents misalignment of the drive gears 91 and 92 connected to the rotational shafts, which in turn avoids failures due to poor engagement between the gear and drive motor.

Further, the process cartridge P according to this patent specification preferably has the second positioning plate 62 fastened to the photoconductor unit 60 rather than to the development unit 50 as in the embodiments described above.

With continued reference to FIG. 12, in general, the photoconductive drum 1 spans an extent greater than that of the developer roller 51 in the development zone H, and the two cylindrical bodies are positioned relative to each other so that the developer roller 51 can face the photoconductive roller 1 at every point along the length of the development zone H.

Figure 14:
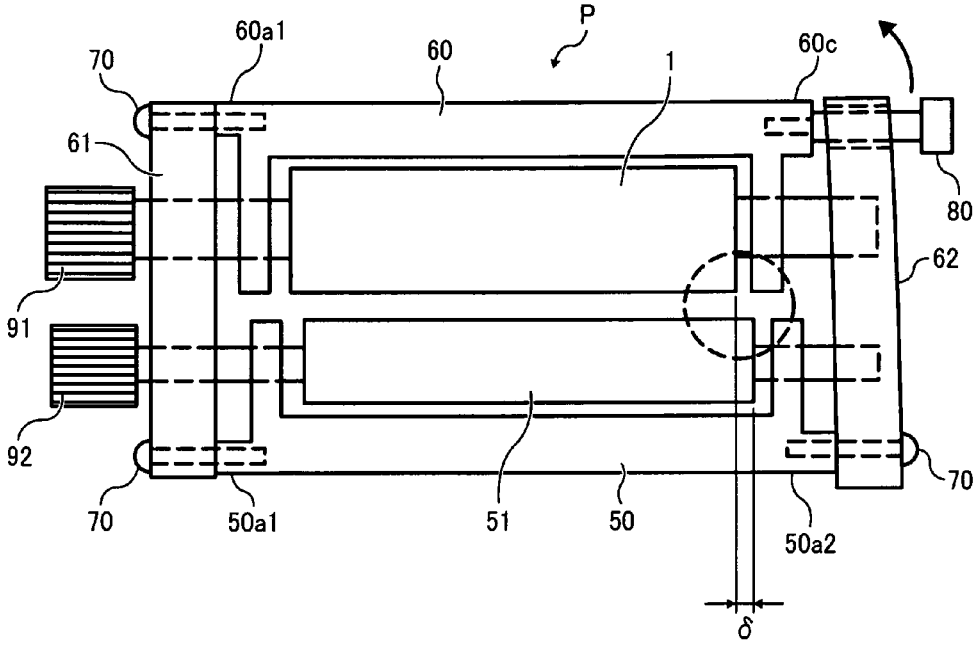
FIG. 14 illustrates a configuration of the process cartridge for comparison with that depicted in FIG. 12.

For purposes of comparison, consider a case in which the second positioning plate 62 is fastened to development unit 50 and not to the photoconductor unit 60 as shown in FIG. 14. In such a case, a deformation developed around the shoulder screw 80 at the free end distal of the fastening point causes a certain amount of offset δ between the ends of the photoconductive drum 1 and the developer roller 51. This creates an incomplete development zone in which the developer roller 51 fails to apply toner to an edge portion of the photoconductive surface, resulting in defective printed images.

By contrast, fastening the second positioning plate 62 to the photoconductor unit 60 as in the embodiment of FIG. 12 prevents an offset between the ends of the photoconductive drum 1 and the developer roller 51, which in turn prevents image defects due to an incomplete development zone between the developer roller 51 and the photoconductive drum 1.

Still further, the process cartridge P according to this patent specification preferably has the subunit fastened to the second positioning plate 62 with one or more protrusions to support the second positioning plate 62 thereon.

Figure 15:
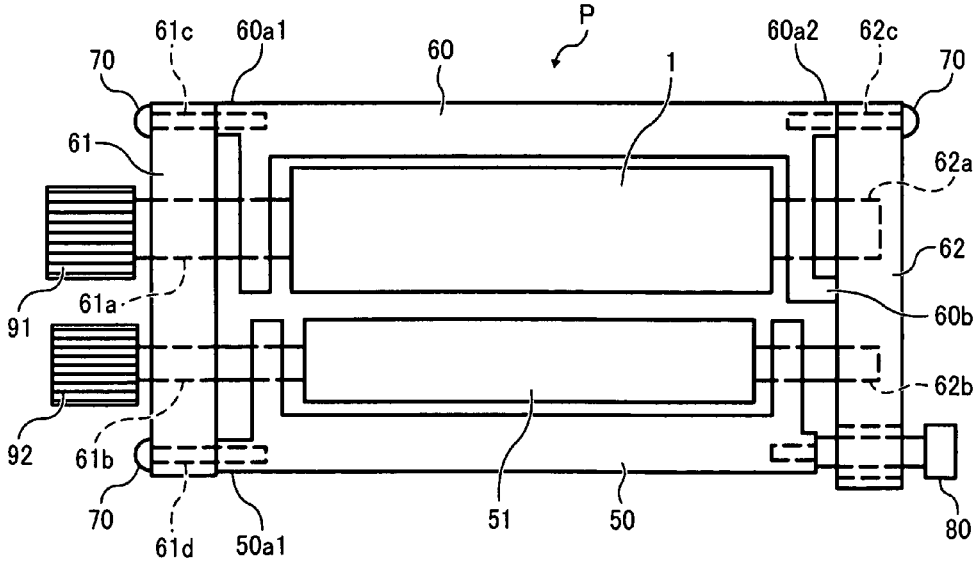
FIG. 15 illustrates another configuration of the process cartridge of FIG. 12.

Specifically, as shown in FIG. 15, the photoconductor unit 60 fastened to the second positioning plate 62 has a boss or protrusion **60*b* in addition to the threaded boss 60*a*2 for receiving the screw 70. Disposed in contact with the second positioning plate 62, the additional boss 60*b* together with the threaded boss 60*a*2 support the second positioning plate 62 on the photoconductor unit 60, thereby preventing it from displacement with respect to the side walls of the process cartridge P. It is to be noted that although the embodiment uses a single boss protruding from the side wall of the photoconductor unit, the number and shape of the support protrusions may be different from those depicted in the example of FIG. 15**.

Thus, in the several embodiments described herein, the process cartridge P according to this patent specification incorporates the positioning mechanism wherein the first positioning member 61 is fastened to both the first and second subunits 60 and 50 to position ends of the photoconductor 1 and the developer applicator 51 on the first side of the respective subunits, and the second positioning member 62 is fastened to one of the first and second subunits 60 and 50 to position ends of the photoconductor and the developer applicator on the second side of the respective subunits. This effects a stable and efficient architecture that can hold the photoconductor and the developer applicator in proper operational position to define a uniform, precision development gap without damaging the photoconductive surface and irrespective of dimensional variations in the lengths of the subunits of the process cartridge P.

Numerous additional modifications and variations are possible in light of the above teachings. For example, although the embodiments described herein depict the process cartridge P as an integral unit formed of a photoconductive drum, a development unit, a charging device, and a cleaning device, the configuration of the process cartridge P may be other than that depicted in the above embodiments as long as it includes a photoconductor and a developer applicator, such as one without charging and cleaning devices, or one equipped with either of charging and cleaning device but not both.

Further, although the embodiments described herein depict the process cartridge P as an imaging station using a two-component developer formed of toner and carrier particles, the positioning mechanism according to this patent specification is applicable to any configuration of an electrophotographic imaging system in which a photoconductor and a developer applicator defines a development gap therebetween, regardless of whether the type of developer used is a two-component developer or a single-component toner.

It is therefore to be understood that, within the scope of the appended claims, the disclosure of this patent specification may be practiced otherwise than as specifically described herein.

What is claimed is:

1. A process cartridge detachably attachable to an image forming apparatus, the process cartridge comprising:

a first subunit to accommodate a photoconductor therein;

a second subunit to accommodate a developer applicator therein;

the photoconductor and the developer applicator arranged substantially parallel to each other to define a development gap therebetween;

a first positioning member fastened to both the first and second subunits to position ends of the photoconductor and the developer applicator on a first side of the respective subunits; and a second positioning member fastened to only one of the first and second subunits to position ends of the photoconductor and the developer applicator on a second side of the respective subunits opposite to the first side.

2. The process cartridge according to claim 1, wherein the second positioning member is out of contact with the subunit to which it is not fastened.

3. The process cartridge according to claim 2, further comprising a motion limiter disposed out of contact with the second positioning member in a first static state to prevent the second positioning member from deformation and displacement, the motion limiter limiting deformation and displacement of the second positioning member when brought into contact with the second positioning member in a second dynamic state by movement of the second positioning member.

4. The process cartridge according to claim 3, wherein the second positioning member remains out of contact with the motion limiter and the subunit to which it is not fastened only when each subunit has a variation in length not exceeding 70% of a specified manufacturing tolerance.

5. The process cartridge according to claim 4, wherein the motion limiter comprises a shoulder screw formed of a shoulder and a male-threaded end, the shoulder extending through a hole in the second positioning member to form a clearance therearound, the male-threaded end engaged with a female thread cut in the subunit to which the second positioning member is not fastened.

6. The process cartridge according to claim 1, wherein the second positioning member is fastened to the one of the first and second subunits at multiple points.

7. The process cartridge according to claim 6, wherein the multiple fastening points are in a single imaginary plane.

8. The process cartridge according to claim 1, wherein the second positioning member is fastened to the one of the first and second subunits at a fastening point proximal to the subunit to which it is not fastened.

9. The process cartridge according to claim 8, wherein the second positioning member is fastened to the one of the first and second subunits at multiple fastening points, including the one proximal to the subunit to which it is not fastened.

10. The process cartridge according to claim 1, wherein the one of the first and second subunits has one or more protrusions to support the second positioning member thereon.

11. The process cartridge according to claim 1, further comprising a drive mechanism mounted on the first side of the respective subunits to impart driving forces to the photoconductor and the developer applicator.

12. The process cartridge according to claim 1, wherein the second positioning member is fastened to the first subunit.

13. An image forming apparatus comprising:

one or more process cartridges detachably attachable to the image forming apparatus to perform electrophotographic imaging processes, each process cartridge including:

a first subunit to accommodate a photoconductor therein;

a second subunit to accommodate a developer applicator therein;

the photoconductor and the developer applicator arranged substantially in parallel to each other to define a development gap therebetween;

a first positioning member fastened to both the first and second subunits to position ends of the photoconductor and the developer applicator on a first side of the respective subunits; and a second positioning member fastened to only one of the first and second subunits to position ends of the photoconductor and the developer applicator on a second side of the respective subunits opposite to the first side.

* * * * *